United States Patent [19]

Matthews et al.

[11] 4,084,743

[45] Apr. 18, 1978

[54] INTERLOCK ARRANGEMENT FOR A STACK DAMPER CONTROL

[75] Inventors: Russell Byron Matthews; Thomas Edward Hayes, both of Goshen, Ind.

[73] Assignee: Johnson Controls, Inc., Milwaukee, Wis.

[21] Appl. No.: 726,951

[22] Filed: Sep. 27, 1976

[51] Int. Cl.[2] ..... F23N 0/00; G05D 23/00

[52] U.S. Cl. ..... 236/1 G; 110/163; 126/286

[58] Field of Search ..... 236/1 G, 45; 110/163; 126/46, 285, 286; 431/20

[56] References Cited

U.S. PATENT DOCUMENTS

| | | | |
|---|---|---|---|
| 2,155,642 | 4/1939 | Dewey | 236/1 G |
| 3,086,583 | 4/1963 | Reichow | 431/71 |
| 3,934,796 | 1/1976 | Smith | 431/20 |

*Primary Examiner*—William E. Wayner
*Assistant Examiner*—Robert J. Charvat
*Attorney, Agent, or Firm*—Emrich, Root, O'Keeffe & Lee

[57] ABSTRACT

A control arrangement for a heating system including a furnace having a fuel-fired burner apparatus and a vent stack with a motor driven damper plate pivotally mounted within the stack, includes a stack damper control circuit including first and second limit switches which permit energization of a drive motor in response to a request for heat, premitting the damper plate to be driven to an open position, and for energizing an interlock switch which prepares an energizing path for fuel supply valves of the system, the first limit switch being operated when the damper plate approaches the open position to complete the energizing path for the fuel supply valves prepared by the interlock switch, and the second limit switch deenergizing the motor when the damper plate is driven to the fully open position. The motor is reenergized at the end of the heating cycle to drive the damper plate to the closed position, and the second limit switch deenergizes the motor when the damper plate reaches the closed position.

15 Claims, 1 Drawing Figure

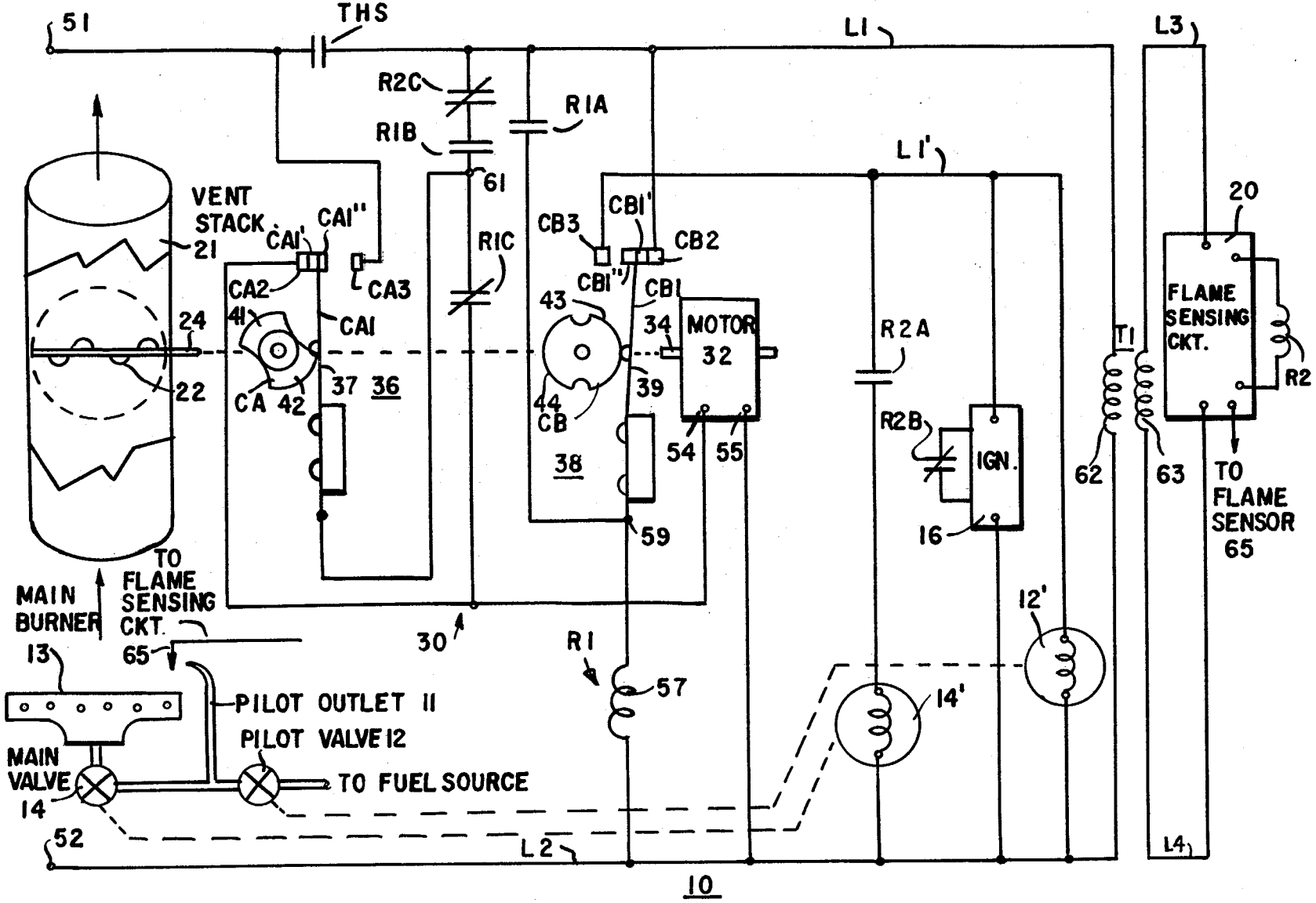
FLAME SENSING CKT.
TO FLAME SENSOR 65
IGN.
MOTOR
VENT STACK
TO FLAME SENSING CKT.
MAIN BURNER
PILOT OUTLET
PILOT VALVE
TO FUEL SOURCE
MAIN VALVE
L1
L1'
L2
L3
L4
T1
R1
R1A
R1B
R1C
R2
R2A
R2B
R2C
THS
CA
CA1
CA1'
CA1''
CA2
CA3
CB
CB1
CB1'
CB1''
CB2
CB3
10
12'
13
14
14'
16
20
21
22
24
30
32
34
36
37
38
39
41
42
43
44
51
52
54
55
57
59
61
62
63
65

INTERLOCK ARRANGEMENT FOR A STACK DAMPER CONTROL

BACKGROUND OF THE INVENTION

1. Field of the Invention

This invention relates to heating systems including furnaces having fuel-fired burners, and, more particularly, to a control arrangement which provides a safety interlock between a stack damper control apparatus and fuel supply apparatus for such systems.

2. Description of the Prior Art

Heating systems employing furnaces having fuel-fired burners require a vent stack to conduct combustion products away from the burner. Automatically controlled stack dampers are generally used in the ventilation stacks to permit the stacks to be closed when the furnace is not operating to minimize heat losses when the furnace is not operating. However, for safe operation, it is necessary that the stack damper be open in advance of each operation of the burner. Accordingly, systems in which automatic dampers are used generally include a control arrangement which provides an interlock between the damper control mechanism and fuel supply apparatus of the system to assure that the damper is fully open before the burner operates and is closed after the completion of the operation of the burner.

In one known arrangement in which a primary burner control is conditional on and subsequent to the opening of a stack damper, a drive motor is energized in response to a request for heat to drive the damper to an open position, and limit switches complete the burner circuit and deenergize the drive motor when the damper reaches the fully open position. The drive motor is reenergized at the end of the heat run to move the damper to the closed position, a further switch deenergizing the motor when the damper reaches the closed position. Movement of the damper from the fully open position permits a limit switch to interrupt the burner circuit. A time lag is provided between the interruption of the burner circuit and the closing of the damper to allow volatiles to be purged from the furnace following operation of the burner.

When operating properly, systems such as the type referred to above provide the desired interlock between the stack damper and the fuel supply apparatus. However, under certain failure conditions, such as the welding together of contacts of the limit switches, or, when cam-operated switches are used, the cams becoming loose and shifting out of place, the fuel supply valves may be energized while the vent stack is closed.

Therefore, it would be desirable to have a control arrangement for use in a heating system which provides a safety interlock between a stack damper control apparatus and fuel supply apparatus of the system which prevents operation of the fuel supply apparatus whenever the damper is in a position other than a fully open position, or in the event of an unsafe failure of the control apparatus.

SUMMARY OF THE INVENTION

It is therefore an object of the present invention to provide a control arrangement for a heating system which provides a safety interlock between stack damper control apparatus and fuel supply apparatus of the system.

Another object of the invention is to provide a heating system including a motor actuated damper apparatus which is interlocked with the fuel valves of the system to permit operation of the fuel valves only when the damper is in a fully open position.

Yet another object of the invention is to provide a control arrangement for a heating system including stack damper control apparatus, which prevents the operation of fuel supply valves of the system in the event of an unsafe failure of the stack damper control apparatus.

Another object of the invention is to provide a heating system of the pilot ignition type including a motor actuated damper apparatus which is interlocked with a pilot flame sensing circuit to prevent operation of fuel valves of the system and the energization of a drive motor of the damper apparatus in the event of an unsafe failure of the flame sensing circuit.

These and other objects are achieved by the present invention which has provided a control arrangement for use in a heating system and which provides a safety interlock between a fuel supply means which supplies fuel to a burner apparatus of the system for combustion to provide heat, and a stack damper control means which controls the positioning of a stack damper plate which is pivotally mounted within a vent stack. The damper plate is normally maintained in a first position to close the vent stack when the system is deactivated, and is rotatable by way of a drive motor to a second position to open the vent stack when the system is activated.

The control arrangement of the present invention comprises activate means responsive to a request for heat to effect the energization of the drive motor to permit the damper plate to be driven towards the second position, interlock means operable when energized to prepare an energizing path for the fuel supply means, and limit switch means for permitting the interlock means to be energized by the activate means when the damper plate is at the first position. The limit switch means is operable when the damper plate has been driven to the second position to deenergize the drive motor and to complete the energizing path for the fuel supply means. The activate means is operable when the heating demand has been met to deenergize the fuel supply means and the interlock means and to effect the reenergization of the drive motor to permit the damper plate to be returned to the first position.

The safety interlock between the fuel supply means and the stack damper control means is provided by the limit switch means, which includes first and second limit switches, and the interlock means. In accordance with a disclosed embodiment, the interlock means is embodied as a switching device, such as a relay, and the first and second limit switches comprise cam operated switches which are coupled to a drive shaft of the motor. The interlock relay is energized over the first limit switch at the start of each heating cycle and operates to close associated contacts which are connected in the energizing path for the drive motor. The second limit switch permits energization of the drive motor when the interlock relay operates, causing the damper plate to be driven to the second or open position. When the damper plate has been driven to the fully open position, the first limit switch operates to complete the energizing path for the fuel supply means, and to interrupt the energizing path for the interlock relay, which is maintained by a holding path provided by further contacts of the relay. In the event that the interlock relay fails to operate at the start of a heating cycle, such as due to a malfunction of either limit switch, as by welding of contacts, or failure of the interlock relay itself, the energizing path for the drive motor is interrupted, so that the damper plate is maintained closed and the energization of the fuel supply means is prevented.

In an application in a pilot-ignition type heating system, including a pilot valve and a main valve, and an electronic pilot flame sensing means, a safety interlock is provided between the fuel supply means and the flame sensing means to permit the interruption of the energizing path for the drive motor in the event of a malfunction of the flame sensing means which would otherwise permit fuel to be supplied to the main burner apparatus in the absence of a flame. In accordance with the invention, the flame sensing means includes a switching means, embodied as a relay, having normally closed contacts connected in the energizing path for the drive motor. The flame sensing means is energized in response to the activate means following a request for heat, so that in the event of a malfunction in the flame sensing means, which permits the relay to operate in the absence of a pilot flame, the relay of the flame sensing means will interrupt the energizing for the drive motor before the damper plate is driven to the open position and before the fuel supply valves are operated. Moreover, the normally closed contacts of the relay are operated by an armature which also controls normally open contacts of the relay which effect the energization of the main valve. Thus, should the normally open contacts become welded closed during a heating cycle the normally closed contacts are prevented from reclosing at the end of the heat run thereby preventing energization of the drive motor in response to the next call for heat.

Thus, the control arrangement of the present invention not only provides for the energization of the fuel supply means only when the damper plate is at the fully open position, but also guards against unsafe failure of one or both limit switches, or in the flame sensing circuit, for systems of the pilot ignition type, preventing the energization of the fuel supply means in the event of such occurrence.

DESCRIPTION OF THE DRAWING

The single FIGURE, which comprises the drawings, is a simplified representation of a heating system employing a control arrangement provided by the present invention.

DESCRIPTION OF PREFERRED EMBODIMENTS

Referring to the drawing, there is shown a simplified representation of a heating system 10 employing a control arrangement provided by the present invention. In the exemplary embodiment, the heating system 10 is of the pilot ignition type. The system 10 includes a fuel-fired heating apparatus having a pilot outlet 11 and a main burner 13, a pilot valve 12, a main valve 14, an igniter circuit 16, and a flame sensing circuit 20. The pilot valve 12 is operable when energized to supply fuel to the pilot outlet 11 for ignition by sparks provided by the igniter circuit 16 to provide a pilot flame. The main valve 14 is operable under the control of the flame sensing circuit 20 to supply fuel to the main burner apparatus 13 for ignition by the pilot flame to establish a flame at the main burner for providing heat for the system.

The heating system 10 further includes a vent stack 21 for venting combustion products away from the main burner when the main burner is lit. A stack damper plate 22 is pivotally mounted within the stack by way of a shaft 24 for movement between closed and open positions under the control of a stack damper control circuit 30, including a drive motor 32. The shaft 24 is mechanically linked to a drive shaft 34 of the drive motor 32 which is operable when energized to drive the damper plate 22 between the closed and open positions.

The damper plate 22 is normally maintained in the closed position, as illustrated in the drawing, when the system 10 is deactivated, so that the vent stack 21 is closed, preventing heat loss via the vent stack 21. In response to a request for heat, the stack damper control circuit 30 energizes the motor 32 to permit the damper plate 22 to be driven from the closed position to the open position, represented by the dotted line in the drawing to permit combustion products to be vented away from the main burner. The stack damper control circuit 30 includes a limit switch 36 which effects the deenergization of the motor 32 when the damper plate 22 reaches the open position. A further limit switch 38 permits energization of the fuel supply valves 12 and 14 to enable a flame to be established at the main burner apparatus to meet the heating demand.

When the heating demand has been met, the stack damper control circuit 30 permits reenergization of the drive motor 32, to permit the damper plate 22 to be driven to the closed position. The limit switch 36 effects the deenergization of the motor 32 when the damper plate 22 reaches the closed position, and the limit switch 38 interrupts the energizing path for the fuel supply valves 12 and 14.

The limit switches 36 and 38 each comprise cam actuated switches, the operation of which is controlled by ways of cams CA and CB. The cams CA and CB, which may comprise a unitary cam structure, are mechanically linked to the shaft 34 of the motor 32. The limit switch 36 includes a movable contact member CA1 having contacts CA1' and CA1'' carried by a resilient switch arm 37 which is movable by way of cam CA, and a pair of fixed contacts CA2 and CA3. Cam actuator portions 41 and 42 are disposed at diametrically opposed positions along the periphery of the cam CA. The actuator portions 41 and 42 are normally disengaged from movable contact member CA1, which is biased to normally permit contact CA1 engage contact CA2 when the damper plate 22 is in the closed position. When the cam CA is rotated clockwise approximately 90°, the actuator portion 41 engages the movable contact member CA1 which then moves contact CA1' out of engagement with contact CA2 and contact CA1'' into engagement with contact CA3. When the cam CA has been rotated through an additional 90°, actuator portion 41 is moved out of engagement with the movable contact CA1, which then moves contact CA1'' out of engagement with contact CA3 and contact CA1' into engagement with contact CA2.

Similarly, limit switch 38 includes a movable contact member CB1 having contacts CB1' and CB1'' carried by a resilient switch arm 39, which is movable by cam CB, and fixed contacts CB2 and CB3. Cam CB has cam actuator portion 43, which normally engages the movable contact member CB1, permitting the contact CB1' to engage contact CB2, and to move contact CB1'' into engagement with contact CB3 with approximately 90° of rotation of the cam CB and prior to movement of the damper plate 22 to the fully open position.

Contacts CA1 and CA2 of limit switch 36 provide a portion of an energizing path for the drive motor 32 when the damper plate 22 is in the closed position and deenergize the motor 32 when the damper plate 22 reaches the fully open position.

Contacts CA1 and CA3 of limit switch 36 provide a portion of a return drive energizing path for the motor 32 and deenergize the motor 32 when the damper plate 22 reaches the closed position. Contacts CB1 and CB2 of limit switch 38 provide an energizing path for an interlock relay R1 when the damper plate 22 is in the closed position. Contacts CB1 and CB3 of limit switch 38 provide an energizing path for the fuel supply valves 12 and 14 when the damper plate 22 is in the open position.

In accordance with the present invention, the stack damper control circuit 30 is interlocked with the fuel ignition valves 12 and 14 by way of the limit switches 36 and 38, the interlock relay R1, and a relay R2 of the flame sensing circuit, which permit energization of the fuel supply valves 12 and 14 only when the damper plate 22 is in the fully open position. The interlock relay R1 is energized over limit switch 38 following the operation of thermostatically controlled contacts THS in response to a request for heat. Relay R1 is operable when energized to close associated contacts R1A which provide a holding path for the relay R1, and to prepare an energizing path for the fuel supply valves 12 and 14. In addition, contacts R1B close to complete an energizing path for motor 32, and contacts R1C open to interrupt the return drive path for the motor 32. When the damper plate 22 has been rotated to the fully open position, limit switch 36 deenergizes the motor 32, and limit switch 38 operates to complete an energizing path over limit switch 38, permitting power to be applied to the pilot valve 12 and the igniter 16, permitting fuel to be supplied to pilot outlet for ignition by sparks provided by the igniter circuit 16.

When a pilot flame is established, the flame sensing circuit 20 effects the energization of the main valve 14 through the operation of associated relay R2, which closes contacts R2A, permitting fuel to be supplied to the main burner apparatus for ignition by the pilot flame. In addition, contacts R2B open to disable the igniter 16, and contacts R2C, which are connected in the energizing circuit for the motor 32, open. Contacts R2C of relay R2 prevent operation of the motor 32 in the event of a malfunction in the flame sensing circuit 20 which would otherwise permit operation of the main valve 14 in the absence of a pilot flame. When relay R1 operates at the start of a heating cycle, the motor 32 is energized over normally closed contacts R2C of relay R2, contacts R1B of relay R1 and limit switch 36 to drive the damper plate 22. Failure of a relay R1 to operate prevents the energization of the motor 32 so that the limit switch 38 cannot operate thereby preventing operation of the pilot valve 12 and the main valve 14.

When the heating demand has been met following a successful heating cycle, the thermostatically controlled contacts THS open, causing relay R1 and the fuel valves 12 and 14 to be deenergized. When relay R1 drops out, contacts R1C complete the energizing path for the motor 32 over limit switch 36, permitting the damper plate 22 to be driven to the closed position. Limit switch 36 operates to deenergize the motor 32 when the damper plate 22 reaches the closed position.

The motor 32, which may be an AC synchronous motor, operates at a specific speed, such as 1RPM, and thus provides sufficient time for the interlock circuit to operate at the start of a heating cycle. The timed closing of the damper plate 22 at the end of each heating cycle allows combustion products to be vented from the vent stack 21 before the damper plate 22 is returned to the closed position.

The position of the damper plate 22 is mechanically interlocked with limit switch 38, allowing actuation of the limit switch 38 only when the damper plate 22 reaches the fully open position. This provides a safety aspect such that it is impossible to manually operate the damper plate 22 to any position other than fully open and simultaneously cause the fuel valves 12 and 14 to be electrically actuated. The energization of relay R1 is prevented in the event of a malfunction of limit switch 38, such as welded contacts, thereby maintaining the fuel supply valves 12 and 14 deenergized. Also, in the event of a malfunction of limit switch 36, the damper plate 22 is either maintained fully open or is continuously driven between open and closed positions with the fuel valves 12 and 14 being energized only when the damper is open. Moreover, the proper operating sequence of the relays R1 and R2 and the limit switches 36 and 38 must be maintained in order to permit the fuel valves 12 and 14 to operate as will be shown hereinafter.

Considering the heating system 10 in more detail, power is supplied to the system 10 over input terminals 51 and 52 thereof which are connectable to a 24 VAC source. Terminal 51 is connected over normally open thermostatically controlled contacts THS to a conductor L1, and terminal 52 is connected directly to a further conductor L2.

The energizing path for relay R1 is provided over limit switch 38 which has contact CB2 connected to conductor L1 and contact CB1 connected to one side of the operate coil 57 of relay R1 at point 59, the other side of which is connected to conductor L2. Accordingly, when contacts CB1 and CB2 are closed, the operate coil 57 of relay R1 is connected between conductors L1 and L2 for energization whenever contacts THS close.

Relay R1 has normally open contacts R1A connected between point 59 and conductor L1 to provide a holding path for the relay R1, and to prepare an energizing path for operating solenoids 12' and 14' of the fuel valves 12 and 14, which is completed by limit switch 38 when the damper plate is in the fully open position. Contact CB3 of limit switch 38 is connected to a conductor L1', permitting power to be supplied to the fuel valve solenoids 12' and 14' when the limit switch 38 is operated to move its switch arm CB1 into engagement with contact CB3.

Relay R1 has normally open contacts R1B connected in series with normally closed contacts R2C of relay R2 between conductor L1 and point 61 which is connected to movable contact CA1 of limit switch 36. Contact CA2 of limit switch 36 is connected to one terminal 54 of the motor 32, which has a second terminal 55 connected to conductor L2, permitting the motor 32 to be energized when relay R1 operates. Relay R1 also has normally closed contacts R1C connected between point 61 and terminal 54 of the motor 32 for providing a return drive energizing path for the motor 32 at the end of each heating cycle over contacts CA1 and CA3 of limit switch 36. Relay R1 is a double-pole, double throw relay, with contacts R1B and R1C employing a common armature of the relay R1. Thus, should contacts R1B become welded together, contacts R1C cannot reclose.

Referring to the fuel supply apparatus, the pilot valve solenoid 12', and the igniter circuit 16 are connected in parallel between conductors L1' and L2. The main valve solenoid 14' is connected between conductors L1' and L2 over normally open contacts R2A of relay R2.

The igniter circuit 16 may, for example, be the type disclosed in the U.S. Pat. application, Ser. No. 698,161 of G. E. Dietz, which is entitled, "Fuel Ignition System Including An Igniter Which Provides A Lingering Spark." The operation of the igniter is disclosed in detail in the referenced application. Briefly, when power is applied to conductor L1', the igniter circuit 16 is energized to provide ignition sparks for igniting fuel supplied to the pilot outlet. When a pilot flame is established, the relay R2 operates, opening contacts R2B, which are connected in an enabling circuit for the igniter circuit, to thereby disable the igniter circuit 16. The igniter circuit 16 continues to provide sparks for a predetermined time following the operation of the relay R2, assuring ignition of the fuel in the event of a malfunction in the flame sensing circuit 20 which allows relay R2 to operate in the absence of a flame.

The flame sensing circuit 20 is energized over a transformer T1, which has a primary winding 62 connected between conductors L1 and L2, and a secondary winding 63 connected between conductors L3 and L4 which are connected to input terminals of the flame sensing circuit 20. The flame sensing circuit 20 may be the type disclosed in U.S. Pat. No. 3,902,839 of Russell B. Matthews, which was issued on Sept. 2, 1975. As disclosed in detail in such patent, the flame sensing circuit 20 includes a flame sensor 65 which is disposed in proximity to the pilot outlet and is responsive to a pilot flame to effect the operation of relay R2 of the flame sensing circuit 20. The relay R2 operates to open contact R2C to interrupt the energizing path to point 61 for the drive motor 32. Relay R2 also opens contacts R2B to disable the igniter circuit 16, and closes contacts R2A to complete the energizing path for the main valve solenoid 14' between conductor L1' and L2. Relay R2 is a double-pole, double throw relay, with contacts R2A and R2C employing a common armature. Thus, if contacts R2A become welded together, contacts R2C cannot reclose when relay R2 is deenergized.

Operation

For the purpose of illustrating the operation of the control arrangement for the heating system 10, it is assumed initially that the system 10 is deactivated with the damper plate 22 in the fully closed position, and that the limit switches 36 and 38 are operated to the positions shown in the drawing. In response to a request for heat, contacts THS close, extending power to conductor L1 for energizing relay R1 over contacts CB1 and CB2 of switch 38. The flame sensing circuit 20 is also energized over transformer T1.

When relay R1 operates, contacts R1A are closed providing a holding path for the relay R1 between conductors L1 and L2, and preparing an energizing path for the pilot valve solenoid 12' and the igniter circuit 16 which extends from conductor L1 and contacts CB1 and CB3 of limit switch 38 to conductor L1'. At this time, the energizing path is interrupted by limit switch 38 since contact CB1 is still engaging contact CB2.

In addition, contacts R1C open, and contacts R1B close completing an energizing path for the drive motor 32 which extends from conductor L1 over normally closed contacts R2C of relay R2, contacts R1B, contacts CA1 and CA2 of limit switch 36 and the motor 32 to conductor L2.

When the motor 32 is energized, the motor shaft 34 rotates, moving the damper plate 22 toward the open position. Cams CA and CB are also driven, and when cam CB has been rotated a few angular degrees less than 90°, and as the damper plate 22 approaches the fully open position, cam CB permits contact CB1 to move out of engagement with contact CB2, and into engagement with contact CB3, completing the energizing path for the pilot valve solenoid 12' and the igniter 16 from conductor L1 over contacts R2A of relay R1 and contacts CB1 and CB3 of limit switch 38.

When cam CA has been rotated 90°, corresponding to the fully open position for the damper plate 22, contact CA1 is moved out of engagement with contact CA2, interrupting the energizing path for the motor 32, and into engagement with contact CA3 to prepare a return drive energizing path for the motor 32.

When the pilot valve solenoid 12' is energized, fuel is supplied to the pilot outlet 11 for ignition by sparks provided by the igniter 16. When a pilot flame is established, the flame sensing circuit 20, senses the pilot flame and effects energization of relay R2. When relay R2 operates, contacts R2C are opened, interrupting the energizing path for the motor 32. In addition, contacts R2B of relay R2 are opened, disabling the igniter 16, and contacts R2A are closed, energizing the main valve solenoid 14', causing fuel to be supplied to the main burner 13 for ignition by the pilot flame to provide heat to satisfy the heating demand for the system 10.

When the heating demand has been met, contacts THS open, interrupting the supply of power to conductor L1, causing the deenergization of the fuel valves 12 and 14, permitting the main burner flame and the pilot flame to be extinguished. The flame sensing circuit 20 and relay R1 are also deenergized, and when relay R1 drops out, contacts R1C close completing the return drive energizing path for the motor 32 over contacts CA1 and CA3 of limit switch 36 for energizing the motor 32 to drive the damper plate 22 to the fully closed position. As the motor shaft 34 is driven, cams CA and CB are rotated. When cam CB has been rotated approximately 5°, switch arm CB1 is moved out of engagement with contact CB3, interrupting the energizing path for the fuel valves 12 and 14, and into engagement with contact CB2 preparing an energizing path for relay R1.

When the damper plate 22 reaches the closed position, cam CA has been rotated approximately 90°, and contacts CA1 and CA3 open, deenergizing the motor 32. Also, contact CA1 reengages contact CA2, preparing an energizing path for the motor 32 over contacts R1B of relay R1. Accordingly, the system 10 is prepared for the next heating cycle.

Safety Aspects

As indicated above, the proper sequencing of the limit switches 36 and 38 and relays R1 and R2 is required to enable the fuel valves 12 and 14 to operate. That is, relay R1 must operate before R2 operates, and the limit switches must be operated to the positions shown in the drawing at the start of a heating cycle. Also, contacts R2C of relay R2 must be closed at the start of a heating cycle to permit eventual energization of the fuel valves 12 and 14.

For a failure of relay R1, such as an open coil 57, then when contacts THS close, relay R1 remains disabled and contacts R1B remain open preventing energization of the motor 32. Also, should contacts R1B become welded closed, then contacts R1C remain open at the end of a heating cycle, preventing reenergization of the motor so that the damper plate 22 is maintained in the fully open position.

Moreover, for a failure in the flame sensing circuit 20 which permits relay R2 to be operated in the absence of a flame, then upon the closure of the contacts THS, relay R2 operates, opening contacts R2C and the energizing path for the motor 32 is interrupted, preventing eventual operation of the pilot valve 12 and the system 10 is maintained in a lock out condition.

In the event of a failure condition following a successful start up, such as the welding together of the contacts R2A which control the operation of the main valve 14, then when the heating demand has been met, and contacts THS open, the pilot valve 12 and the main valve 14 are deenergized, extinguishing the flame. The flame sensing circuit 20 responds to the loss of flame to deenergize relay R2. However, since contacts R2A are welded together, contacts R2C cannot reclose since such contacts employ a common armature of the relay R2. Accordingly, when contacts THS close on the next call for heat, the energizing path for the motor 32 is interrupted since contacts R2C are open. Thus, the pilot valve 12 and the main valve 14 are maintained deenergized.

In the event contact CB1 of limit switch 38 becomes welded to contact CB2, then, following activation of the system 10 through operation of contacts THS, relay R1 operates on the motor 32 moves the damper plate 22 to the open position and stops. However, the pilot valve 12 and main valve 14 remain deenergized because movable contact CB1 cannot engage fixed contact CB3 to complete the energizing path to the fuel valves 12 and 14. The motor 32 remains deenergized as long as THS are closed. When contacts THS open, relay R1 drops out, and the motor returns the damper plate 22 to the closed position.

For the condition where contact CB1 of limit switch 38 becomes welded to fixed contact CB3, then, on the next call for heat, the relay R1 cannot be energized because the energizing path provided over contacts CB1 and CB2 is interrupted.

Considering limit switch 36, should contact CA1 become welded to contact CA3, the motor 32 continues to run during the time contacts THS are open. When contacts THS close, relay R1 is energized when contacts CB1 and CB2 close. This causes contacts R1C to open stopping the motor 32 and terminating the heating cycle.

If contact CA1 becomes welded to contact CA2, then when contacts THS close the motor 32 will continue to run, driving the damper plate 22 between the open and closed positions, permitting the valves 12 and 14 to be energized each time contacts CB1 and CB3 close at which time the damper plate 22 is in the fully open position.

We claim:

1. In a heating system including a furnace having a fuel fired burner apparatus, fuel supply means operable when energized to supply fuel to said burner apparatus for combustion to provide heat, a vent stack for conducting combustion products away from said burner apparatus, and stack damper means including a drive motor, and a stack damper plate pivotally mounted within said vent stack, said damper plate being normally maintained at a first position to close said vent stack and being rotatable to a second position to open said vent stack, said drive motor being operatively coupled to said damper plate for driving said damper plate between said first and second positions, a control arrangement comprising activate means responsive to a request for heat to effect the energization of said drive motor over an energizing path to permit said damper plate to be driven from said first position towards said second position, switching means, limit switch means having first contacts connected in an energizing path for said switching means and second contacts connected in an energizing path for said fuel supply means, said limit switch means being coupled to said stack damper means for operation thereby to close said first contacts providing an energizing path for said switching means and to open said second contacts, interrupting the energizing path for said fuel supply means when said damper plate is at first position, to permit said switching means to be energized by said activate means when said first contacts are closed, said activate means causing said switching means to operate to close third contacts which are connected in said energizing path for said fuel supply means, said stack damper means operating said limit switch means in response to said drive motor driving said damper to said second position to open said first contacts to interrupt said energizing path for said switching means and to close said second contacts to complete said energizing path for said fuel supply means for energizing said fuel supply means, said activate means being operable when the heating demand has been met to deenergize said fuel supply means and said switching means and to effect the reenergization of said drive motor to permit said damper plate to be driven from said second position to said first position.

2. A system as set forth in claim 1 wherein said limit switch means includes a first limit switch having said first and second contacts, and a second limit switch for preparing said energizing path for said drive motor when said damper plate is at said first position, and operable when said damper plate has been driven to said second position to interrupt said energizing path for said drive motor.

3. A system as set forth in claim 2 wherein said second limit switch is operable to prepare a return drive energizing path for said motor when said damper plate is driven to said second position, said return drive path being completed by further contacts of said switching means which close when said switching means is deenergized, and said second limit switch being operated to interrupt said return drive path for said motor when said damper plate is driven to said first position.

4. A system as set forth in claim 2 wherein said first and second limit switches are coupled to said drive motor for operation thereby.

5. A system as set forth in claim 1 wherein said fuel supply means includes pilot valve means and main valve means, said pilot valve means being connected to said fuel supply means energizing path for operation, whenever said fuel supply means energizing path is completed, to supply fuel to a pilot outlet for ignition to establish a pilot flame, and flame sensing means, including further switching means energized when a pilot flame is established, to effect the energization of said main valve means permitting fuel to be supplied to a main burner apparatus for ignition by the pilot flame.

6. A system as set forth in claim 5 wherein said flame sensing means is energized responsive to said activate means, said energizing path for said drive motor being interrupted whenever said further switching means is operated thereby preventing energization of said fuel supply means in the event said further switching means operates prior to said damper plate being driven to said second position.

7. In a heating system including a furnace having a fuel-fired burner apparatus, fuel supply means operable when energized to supply fuel to said burner apparatus for combustion to provide heat, a vent stack for conducting combustion products away from said burner apparatus, and stack damper means including a drive motor, and a damper plate pivotally mounted within said vent stack, said damper plate being normally maintained in a first position to close said vent stack and being rotatable to a second position to open said vent stack, said drive motor being operatively coupled to said damper plate for driving said damper plate between said first and second positions, a control arrangement comprising switching means for controlling the energization of said fuel supply means and said drive motor, a first limit switch for controlling the energization of said switching means and said fuel supply means, said first limit switch having first contacts connected in an energizing path for said switching means and second contacts connected in an energizing path for said fuel supply means, said first limit switch being coupled to said stack damper means for operation thereby to close said first contacts and to open said second contacts when said damper plate is at said first position to permit the energization of said switching means, and a second limit switch for preparing an energizing path for said drive motor when said damper plate is at said first position, activate means responsive to a request for heat to energize said switching means causing said switching means to operate to close contacts connected in said energizing path for said fuel supply means and to close further contacts to complete said energizing path for said drive motor for energizing said drive motor to cause said damper plate to be driven to said second position, said second limit switch interrupting said energizing path for said drive motor to deenergize said drive motor when said damper plate has been driven to said second position, said stack damper means operating said first limit switch when said damper plate has been driven to said second position to open said first contacts to interrupt said energizing path for said switching means and to close said second contacts to complete said energizing path for said fuel supply means, said activate means causing said fuel supply means and said switching means to be deenergized when the heating demand has been met, permitting said drive motor to be reenergized over a return drive path, including said second limit switch, to cause said damper plate to be driven to said first position, said second limit switch being operated to interrupt said return drive path when said damper plate has been driven to said first position to deenergize said drive motor.

8. A system as set forth in claim 7 wherein said first limit switch has a first actuator means coupled to said drive motor for operating said first and second contacts, and wherein said second limit switch has third contacts connected in said energizing path for said drive motor and fourth contacts connected in said return drive path for said drive motor, and a second actuator means coupled to said drive motor for operating said third and fourth contacts.

9. A system as set forth in claim 8 wherein said first actuator means includes a first cam member coupled to said drive motor and operable to permit said first contacts to be maintained normally closed and said second contacts to be maintained normally open when said damper plate is at said first position, and for opening said first contacts and closing said second contacts when said damper plate is at said second position, and said second actuator means includes a second cam member coupled to said drive motor and operable to maintain said third contacts normally closed and said fourth contacts normally open when said damper plate is at said first position, and for permitting said third contacts to open and said fourth contacts to close when said damper plate is at said second position.

10. A system as set forth in claim 9 wherein said first and second contacts are operated by a common switch member whereby the energization of said switching means is prevented, thereby preventing the energization of said fuel supply means in the event of a malfunction of said first limit switch which permits said second contacts to be closed when said damper plate is at said first position.

11. A system as set forth in claim 8 wherein said fuel supply means includes pilot valve means and main valve means, said pilot valve means being connected to said energizing path for operation whenever said energizing path is completed to supply fuel to a pilot outlet for ignition to establish a pilot flame, and flame sensing means including further switching means energized when a pilot flame is established to effect the energization of said main valve means permitting fuel to be supplied to a main burner for ignition by the pilot flame.

12. A system as set forth in claim 11 wherein said further switching means comprises a further relay having normally closed contacts connected in said energizing path for said drive motor and normally open contacts connected in an energizing path for said main valve means, said normally open contacts and said normally closed contacts being operated by a common armature whereby said normally closed contacts are prevented from reclosing whenever said normally open contacts are welded together, thereby preventing energization of said drive motor in response to a request for heat.

13. A system as set forth in claim 7 wherein said further contacts of said switching means comprise normally open contacts connected in said energizing path for said drive motor and normally closed contacts connected in said return drive path for said drive motor.

14. A system as set forth in claim 13 wherein said switching means comprises a relay having said normally open contacts and said normally closed contacts operated by a common armature whereby said normally closed contacts are prevented from reclosing whenever said normally open contacts are welded together, thereby preventing the reenergization of said drive motor so that said damper plate is maintained at said second position.

15. In a heating system including a furnace having a fuel fired burner apparatus, fuel supply means operable when energized to supply fuel to said burner apparatus for combustion to provide heat, a vent stack for conducting combustion product away from said burner apparatus, and stack damper means, including a drive motor, and a stack damper plate pivotally mounted within said vent stack, said damper plate being normally maintained at a first position to close said vent stack and being rotatable to a second position to open said vent stack, said drive motor being operatively coupled to said damper plate for driving said damper plate between said first and second positions, a control arrangement comprising first limit switch means coupled to said stack damper means for operation thereby for controlling the energization and deenergization of said drive motor to permit said damper plate to be driven between said first and second positions, switching means operable when energized to permit energization of said fuel supply means, second limit switch means having first contacts connected in an energizing path for said switching means and second contacts connected in an energizing path for said fuel supply means, said second limit switch means being coupled to said stack damper means for operation thereby to close said first contacts and to open said second contacts when said damper plate is at said first position, activate means operable in response to a request for heat to connect power to said energizing path for said switching means causing said switching means to operate to close third contacts which are connected in said energizing path for said fuel supply means, said stack damper means operating said second limit switch means in response to said drive motor driving said damper plate to said second position to open said first contacts to interrupt said energizing path for said switching means and to close said second contacts to complete said energizing path for said fuel supply means, said switching means being prevented from operating to close said third contacts in the event that said first contacts are open, interrupting the energizing path for said fuel supply means when said damper plate is at said first position.

* * * * *